US007494615B2

(12) United States Patent
Burke et al.

(10) Patent No.: US 7,494,615 B2
(45) Date of Patent: Feb. 24, 2009

(54) SUPPLYING SOLID FEED MATERIALS FOR A DIRECT SMELTING PROCESS

(75) Inventors: Peter Damian Burke, Winthrop (AU); David John Leigh, Kensington (AU)

(73) Assignee: Technological Resources Pty. Limited, Melbourne (AU)

( * ) Notice: Subject to any disclaimer, the term of this patent is extended or adjusted under 35 U.S.C. 154(b) by 389 days.

(21) Appl. No.: 11/247,286

(22) Filed: Oct. 12, 2005

(65) Prior Publication Data

US 2006/0119020 A1 Jun. 8, 2006

(30) Foreign Application Priority Data

Oct. 12, 2004 (AU) ..... 2004905901

(51) Int. Cl.
*C21B 13/00* (2006.01)

(52) U.S. Cl. ..... 266/225; 266/44; 266/267

(58) Field of Classification Search ..... 266/225, 266/142, 144, 267, 44
See application file for complete search history.

(56) References Cited

U.S. PATENT DOCUMENTS 3,710,808 A 1/1973 Celada et al.
4,519,587 A 5/1985 Peckels et al.
6,379,424 B1 4/2002 Dry
6,989,126 B2 * 1/2006 Leigh ..... 266/225
7,201,868 B2 * 4/2007 Ions et al. ..... 266/142
2001/0022417 A1 9/2001 Burrow
2003/0071399 A1 4/2003 Leigh

FOREIGN PATENT DOCUMENTS

WO WO2004/090173 A1 10/2004

OTHER PUBLICATIONS

Cusack B. L. et al.; "Initial Operation of the Hismelt Research and Development Facility" Iron and Steelmaker, Warrendale, WA, US, vol. 22, No. 2, Feb. 1995, pp. 13-20, XP009008584, ISSN: 0275-8687.

* cited by examiner

*Primary Examiner*—Scott Kastler
(74) *Attorney, Agent, or Firm*—Oblon, Spivak, McClelland, Maier & Neustadt, P.C.

(57) ABSTRACT

A direct smelting plant that includes an effective and reliable solids feed means for injecting solid feed materials, particularly carbonaceous material, into a direct smelting vessel of the plant is disclosed. The solid feed means is characterised by independent supply of carbonaceous material to injection lances. The independent supply of carbonaceous material minimises the possible adverse impact of a breakdown of one or more than one lance or a breakdown of the carbonaceous material injection means for that lance or lances.

24 Claims, 2 Drawing Sheets

SUPPLYING SOLID FEED MATERIALS FOR A DIRECT SMELTING PROCESS

BACKGROUND OF THE INVENTION

Field of the Invention

The present invention relates to a direct smelting plant and process for producing molten metal from a metalliferous feed material such as ores, partly reduced ores and metal-containing waste streams.

In particular, the present invention relates to a direct smelting plant and process for producing molten iron from an iron-containing feed material.

In particular, the present invention relates to a solids feed means for injecting solid carbonaceous material to a direct smelting vessel in a direct smelting plant.

DISCUSSION OF THE BACKGROUND

A known direct smelting process, which relies principally on a molten bath as a reaction medium, is generally referred to as the HIsmelt process. In the context of producing molten iron, the HIsmelt process includes the steps of:

(a) forming a bath of molten iron and slag in a direct smelting vessel;

(b) injecting into the bath: (i) a metalliferous feed material, typically iron ore in the form of fines; and (ii) a solid carbonaceous material, typically coal, which acts as a reductant of the iron ores and a source of energy; and (c) smelting metalliferous feed material to iron.

The term "smelting" is herein understood to mean thermal processing wherein chemical reactions that reduce metal oxides take place to produce molten metal.

In the HIsmelt process metalliferous feed material and solid carbonaceous material is injected into the molten bath through a number of lances/tuyeres which are inclined to the vertical so as to extend downwardly and inwardly through the side wall of the smelting vessel and into a lower region of the vessel so as to deliver at least part of the solids material into the metal layer in the bottom of the vessel. To promote the post-combustion of reaction gases in an upper part of the vessel, a blast of hot oxygen-containing gas, typically air or oxygen-enriched air, which may be oxygen-enriched, is injected into an upper region of the vessel through a downwardly extending lance. Offgases resulting from the post-combustion of reaction gases in the vessel are taken away from the upper part of the vessel through an offgas duct. The vessel includes refractory-lined water cooled panels in the side wall and the roof of the vessel, and water is circulated continuously through the panels in a continuous circuit.

The HIsmelt process enables large quantities of molten metal, such as molten iron, to be produced by direct smelting in a single compact vessel.

However, in order to achieve this it is necessary to supply large quantities of solid feed materials, such as iron ores, carbonaceous material, and fluxes (typically lime and dolomite), to the solids injection lances.

Operation of the HIsmelt process for smelting campaigns of at least 12 months is an important issue. The term "smelting campaign" is understood herein to mean operation of the HIsmelt process without a total shutdown of the process involving end tapping of molten metal and slag from a direct smelting vessel. Smelting campaigns of this length depend on a number of factors. One such factor is reliable injection of feed materials into the vessel.

SUMMARY OF THE INVENTION

The present invention provides an effective and reliable solids feed means for injecting solid feed materials into a direct smelting vessel during a HIsmelt smelting campaign.

In particular, the present invention provides a solids feed means that minimises the risk of interruptions of the supply of solid carbonaceous material that would cause shut-down of a HIsmelt smelting campaign. The reliable supply of solid carbonaceous material into a direct smelting vessel is critical to achieve smelting campaigns of at least 12 months. The HIsmelt process can be held indefinitely provided the vessel has a supply of oxygen-containing gas, typically hot blast air, and solid carbonaceous material, typically coal. Loss of carbonaceous material supply for greater than 8-12 hours results in end tapping of the vessel, causing significant downtime.

In general terms, the present invention provides a carbonaceous material feed means for a direct smelting plant that is characterised by independent supply of carbonaceous material to lances for injecting carbonaceous material into the vessel. The independent supply of carbonaceous material minimises the possible adverse impact of a breakdown of one or more than one lance or a breakdown of the carbonaceous material injection means for that lance or lances.

According to the present invention there is provided a direct smelting plant for producing molten metal from a metalliferous feed material in a direct smelting process, the direct smelting plant including:

(a) a direct smelting vessel for holding a molten bath of metal and slag and a gas space above the bath;

(b) a solids feed means in the form of a means for injecting ground or pulverised solid carbonaceous material into the vessel, the carbonaceous material feed means including a grinding or pulverising means for producing ground or pulverised solid carbonaceous material, a plurality of lances for injecting the carbonaceous material into the vessel, and a carbonaceous material injection means for supplying ground or pulverised carbonaceous material under pressure to the lances and injecting carbonaceous material into the vessel via the lances, whereby the carbonaceous material injection means is adapted to supply carbonaceous material to each lance independently of the supply of carbonaceous material to the other lance or lances so that a breakdown of one or more than one lance or a breakdown of the carbonaceous material injection means for that lance or lances does not prevent the supply of carbonaceous material to the remaining operating lance or lances;

(c) a separate solids feed means in the form of a means for injecting solid metalliferous feed material into the vessel, the metalliferous material feed means including a plurality of lances for injecting metalliferous feed material into the vessel;

(d) a gas injection means for injecting an oxygen-containing gas into the vessel;

(e) an offgas duct means for facilitating flow of offgas from the vessel away from the vessel;

(f) a metal tapping means for tapping molten metal from the bath and transporting that molten metal away from the vessel; and (g) a slag tapping means for tapping slag from the bath and transporting that slag away from the vessel.

The above-described independent supply of carbonaceous material to the carbonaceous material injection lances minimises the possible adverse impact of a a breakdown of one or more than one lance or a breakdown of the carbonaceous material injection means for that lance or lances.

There may be situations in which loss of supply of carbonaceous material to one or more than one lance for a short period of time is not a serious issue and the process can continue to run without changing the amount of carbonaceous material supplied by the remaining lance or lances and by making appropriate adjustment to other process operating conditions.

However, in situations where the loss of supply of carbonaceous material to one or more than one lance is undesirable, it is preferable that the carbonaceous material injection means be capable of supplying increased amounts of carbonaceous material to the remaining lance or lances to at least partially compensate for the loss of supply via the out of service lance or lances.

Preferably the carbonaceous material injection means includes a hopper for storing ground or pulverised solid carbonaceous material.

Preferably the storage hopper is adapted to store ground or pulverised solid carbonaceous material at ambient pressure.

Preferably the storage hopper is capable of holding an amount of ground or pulverised solid carbonaceous material required for at least 10 hours, more preferably at least 12 hours, production at full production rate of the direct smelting process.

Preferably the carbonaceous material injection means includes separate supply lines for each of the lances.

Preferably the carbonaceous material injection means includes a single unit that includes the storage hopper and a means for supplying ground or pulverised carbonaceous material from the storage hopper into each of the supply lines.

Preferably the storage hopper is designed to split the carbonaceous material into a plurality of uniform streams for feeding into the supply lines.

Preferably the carbonaceous material injection means includes a means for supplying ground or pulverised carbonaceous material from the storage hopper under pressure into each of the supply lines.

Preferably the supply means includes a series of lock hoppers for receiving ground or pulverised carbonaceous material from the storage hopper and storing the material under pressure.

Preferably the supply means includes a means for supplying inert gas to the lock hoppers for pressurising the lock hoppers.

Preferably the supply means includes a feed means connected to the lock hoppers for receiving and delivering controlled amounts of pressurised ground or pulverised carbonaceous material from the lock hoppers into the supply lines.

Preferably the supply means includes a means for supplying inert gas into the supply lines for transporting ground or pulverised carbonaceous material under pressure along the supply lines to the lances, with each lance receiving and injecting into the vessel a separate supply of carbonaceous material from the storage hopper.

Preferably the lances for injecting ground or pulverised carbonaceous material and metalliferous feed material are arranged in diametrically opposed pairs.

Preferably the supply means supply different solid feed materials to adjacent lances.

Preferably the metalliferous material feed means includes a main supply line and a pair of branch lines for supplying metalliferous feed material to the or each pair of lances.

Preferably the metalliferous material feed means includes a hot metalliferous feed material injection means for supplying pre-heated metalliferous feed material to the main supply line or lines of the feed means.

Preferably the metalliferous feed material is iron ore fines.

Preferably the hot metalliferous feed material injection means is operable to pre-heat the iron ore fines for injection into the vessel at a temperature in the range of 650-700° C., more preferably of the order of 680° C.

Preferably the plant includes a solids feed means for injecting flux into the vessel.

Preferably the flux feed means includes a flux injection means for supplying flux under pressure into at least one supply line of the carbonaceous material feed means.

Preferably the flux is dolomite.

Preferably the flux feed means includes a flux injection means for supplying flux under pressure into at least one main supply line of the metalliferous material feed means.

Preferably the flux is lime.

Preferably the plant includes a solids feed means for injecting waste oxides into the vessel.

Preferably the waste oxides feed means includes a waste oxides injection means for supplying waste oxides under pressure into at least one supply line of the carbonaceous material feed means.

Preferably the vessel is a vertical cylindrical vessel and the plurality of solids injection lances are spaced circumferentially around the vessel.

Preferably the side wall of the vessel includes water-cooled panels.

Preferably the vessel includes a roof and the roof includes water-cooled panels.

Preferably the metal tapping means is a forehearth.

Preferably the oxygen-containing gas is air or oxygen-enriched air.

According to the present invention there is also provided a solids feed means for a direct smelting vessel of a direct smelting plant for producing molten metal from a metalliferous feed material in a direct smelting process, which solids feed means includes a means for injecting ground or pulverised solid carbonaceous material into the vessel, the carbonaceous material feed means including a grinding or pulverising means for producing ground or pulverised solid carbonaceous material, a plurality of lances for injecting the carbonaceous material into the vessel, and a carbonaceous material injection means for supplying ground or pulverised carbonaceous material under pressure to the lances and injecting carbonaceous material into the vessel via the lances, whereby the carbonaceous material injection means is adapted to supply carbonaceous material to each lance independently of the supply of carbonaceous material to the other lance or lances so that a breakdown of one or more than one lance or a breakdown of the carbonaceous material injection means for that lance or lances does not prevent the supply of carbonaceous material to the remaining operating lance or lances.

According to the present invention there is also provided a direct smelting process for producing molten metal from a metalliferous feed material in the above-described direct smelting plant that includes producing ground or pulverised solid carbonaceous material and supplying separate streams of ground or pulverised carbonaceous material under pressure to a plurality of lances extending into a direct smelting vessel of the plant and injecting ground or pulverised carbonaceous material into the vessel via the lances.

In a situation in which it is necessary to take one or more than one lance out of service or the carbonaceous material injection means for that lance or lances out of service, preferably the process includes supplying increased amounts of ground or pulverised carbonaceous material to one or more of the remaining lance or lances in order to at least partially compensate for the loss of supply of material supplied to the vessel.

BRIEF DESCRIPTION OF THE DRAWINGS

The present invention is described in more detail hereinafter with reference to the accompanying drawings, of which.

DETAILED DESCRIPTION OF PREFERRED EMBODIMENTS

Figure 1:
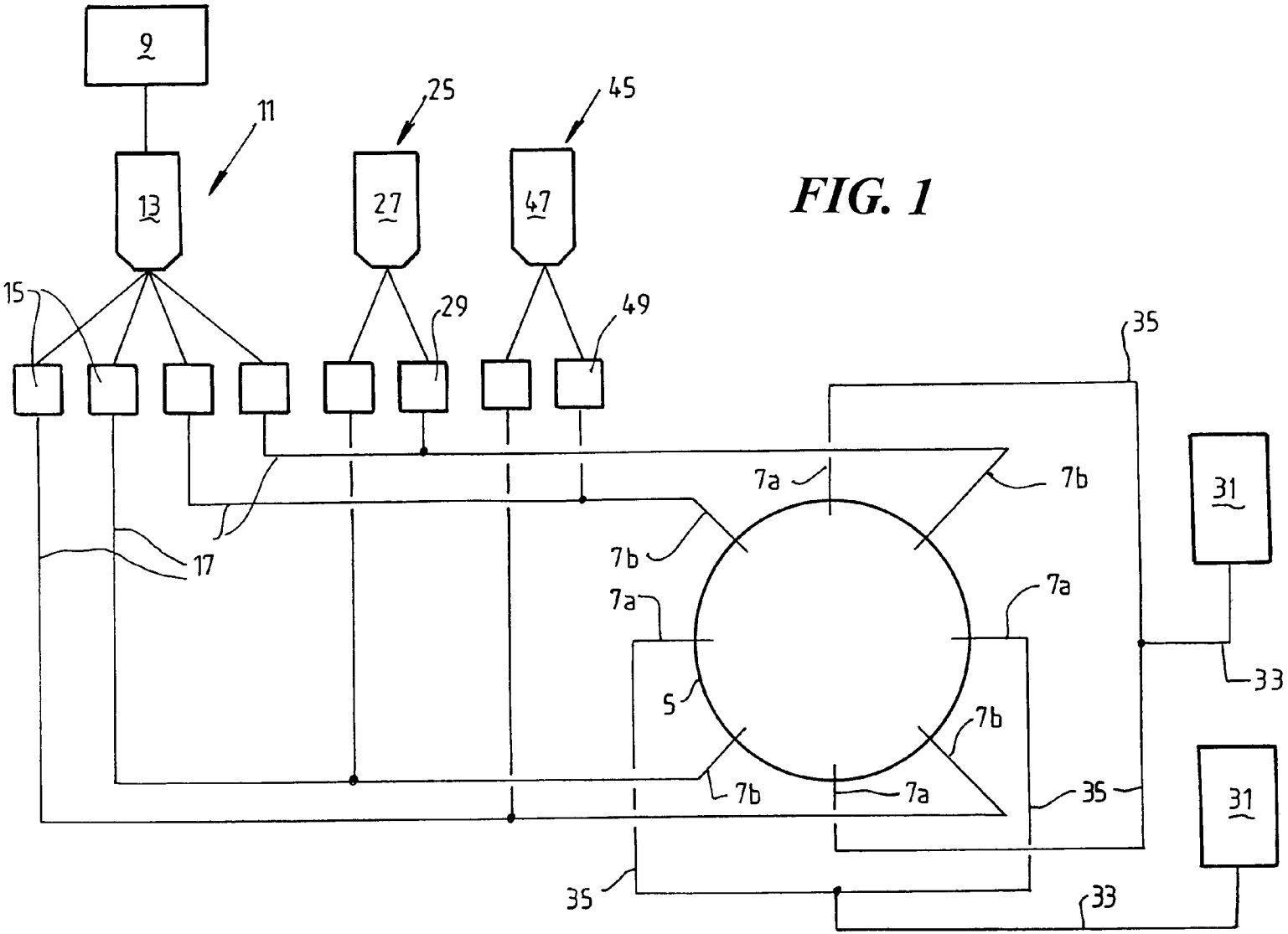
FIG. 1 is a diagram of a solids feed means for a direct smelting vessel of a direct smelting plant in accordance with one embodiment of the present invention.

FIG. 1 shows a solids feed means that, in use, supplies solid feed material, namely coal, flux, iron ore fines, and waste oxides, and a $N_2$ carrier gas into a direct smelting vessel SRV ("smelt reduction vessel") as part of a process for direct smelting iron ore and producing molten iron in the vessel SRV.

The vessel SRV may be any suitable vessel for carrying out a direct smelting process such as the HIsmelt process described above.

Australian patent application 27990/01 in the name of the applicant includes a description of the general construction of a HIsmelt vessel and the disclosure in the Australian patent application is incorporated herein by cross-reference.

In basic terms, the HIsmelt vessel described in Australian patent application 27990/01 and shown in FIG. 1 has: a hearth (not shown) that includes a base and sides formed from refractory bricks; side walls 5 which form a generally cylindrical barrel extending upwardly from the sides of the hearth and include an upper barrel section and a lower barrel section; a roof (not shown); an outlet for offgases (not shown); a forehearth (not shown) for discharging molten metal continuously; and a tap-hole (not shown) for discharging molten slag.

The vessel SRV contains a molten bath of iron and slag which includes a layer of molten metal and a layer of molten slag on the metal layer.

The vessel SRV is fitted with a downwardly extending gas injection lance (not shown) that delivers a hot air blast into an upper region of the vessel and eight solids injection lances 7*a*, 7*b* extending downwardly and inwardly through a side wall 5 and into the slag layer that inject iron ore, solid carbonaceous material, and fluxes entrained in an oxygen-deficient carrier gas into the metal layer.

The gas injection lance receives an oxygen enriched hot air flow through a hot gas delivery duct (not shown) which extends from a hot gas supply station (not shown) located some distance away from the vessel SRV.

The position of the solids injection lances 7*a*, 7*b* is selected so that their outlet ends are above the surface of the metal layer during operation of the direct smelting process. This position of the lances reduces the risk of damage through contact with molten metal and also makes it possible to cool the lances by forced internal water cooling without significant risk of water coming into contact with the molten metal in the vessel SRV.

The solids injection lances 7*a*, 7*b* form part of the solids feed means that supplies coal, flux (typically dolomite and lime), waste oxides, and iron ore to the lances 7*a*, 7*b* and injects the solids into the vessel SRV via the lances during operation of the direct smelting process.

The solids feed means includes an iron ore feed means that supplies iron ore, in the form of fines, to each of the four injection lances 7*a*, arranged in diametrically opposed pairs of lances 7*a*, and injects fines via the lances 7*a* into the vessel SRV during operation of the direct smelting process. The iron ore feed means includes two hot ore injection means, generally identified by the numeral 31, and main supply lines 33 and branch lines 35 connecting the hot ore injection means 31 and the lances 7*a*. Each hot ore injection means 31 supplies hot ore fines to one of the diametrically opposed pairs of lances 7*a* via the main supply line 33 and the branch lines 35 that interconnect the hot ore injection means 31 and the lance pair. $N_2$ carrier gas transports hot ore fines from the hot ore injection means 33 through the main supply lines 33 and the branch lines 35 to the lances 7*a* and injects the hot ore fines into the vessel SRV.

The solids feed means also includes a coal feed means that supplies separate streams of coal, in the form of dried and ground or pulverised coal, to the four injection lances 7*b*, also arranged in diametrically opposed pairs, and injects coal via the lances into the vessel SRV during operation of the direct smelting process.

The coal feed means is arranged to supply coal to each lance 7*b* independently of the other lances 7*b* so that a breakdown of one or more than one lance or a breakdown in the coal feed means for supplying coal to that lance or lances does not prevent the supply of coal to the other lance or lances.

The coal feed means includes a coal drying and grinding plant, generally identified by the numeral 9, and a coal injection means, generally identified by the numeral 11.

Coal from a stock pile (not shown), which may be wet coal, is delivered via a coal conveyor from the stock pile to the coal drying and grinding plant 9.

The coal drying and grinding plant 9 includes a wet coal surge bin (not shown) that stores the coal.

The plant 9 also includes wet coal feeders (not shown) that extract coal from the surge bin and feed it into a grinding mill (not shown) of the plant 9. The grinding mill grinds and dries wet coal to a specification required for injection into the vessel SRV.

The plant 9 also includes a dry coal extraction system (not shown) made up of cyclones and/or bag filters that extract dry, ground/pulverised coal from the grinding mill and delivers it to the coal injection system 11.

The coal injection means 11 includes a storage hopper 13 that stores coal from the coal drying and grinding plant 9 under ambient pressure. Typically, the storage hopper 13 can hold an amount of coal that is sufficient to allow the plant to operate at full production capacity for at least 10 hours. The storage hopper 13 includes four downwardly depending legs (not shown) that form four separate coal outlets of the hopper. The legs allow uniform streams of coal to flow from the storage hopper 13. As is described hereinafter, coal discharged via each outlet leg is supplied to one of the four coal injection lances 7*b*. Coal supplied to an upper section of the storage hopper 13 progressively moves downwardly in the hopper 13 and into the outlet legs as coal is discharged from the hopper 13 via the outlet legs. The outlet legs facilitate a uniform split of coal to be supplied subsequently to the lances 7*b*. Advantageously, a fluidising gas, such as an inert gas, is supplied to the storage hopper 13 to fluidise coal in at least the outlet legs to minimise the possibility of blockages in the outlet legs.

The coal injection means 11 also includes a separate coal supply line 17 for each of the four coal injection lances 7*b*.

The coal injection means 11 also includes a supply means, generally identified by the numeral 15, that supplies controlled amounts of coal from the storage hopper 13 into the coal supply lines 17 and transports the coal under pressure along the supply lines 17 to the lances 7*b* and injects coal from the lances 7*b* into the vessel SRV.

Figure 2:
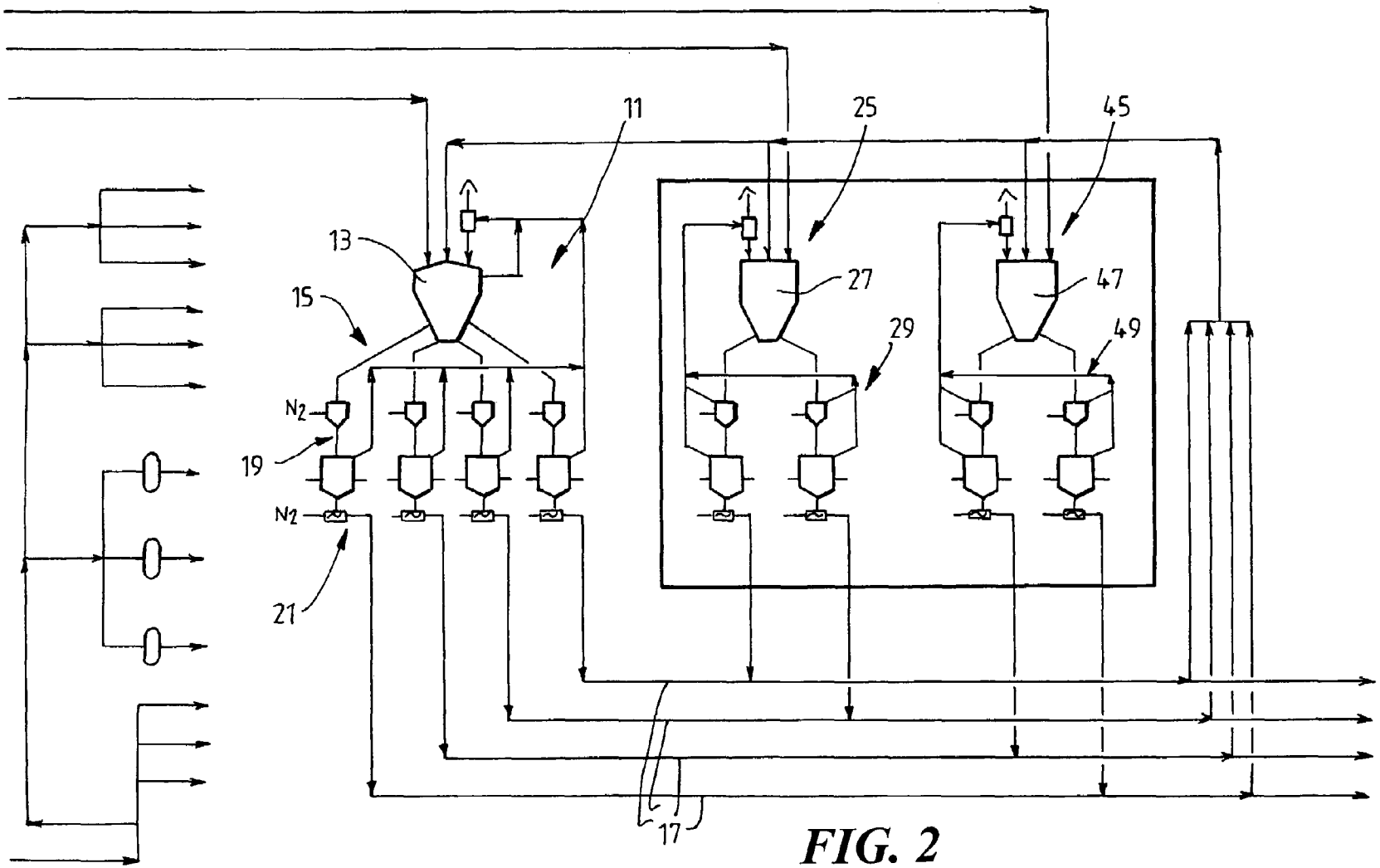
FIG. 2 is a diagram that shows in detail the solids feed means for carbonaceous material, dolomite, and waste oxides shown in FIG. 1.

As shown in FIG. 2, the coal supply means 15 includes four sets of lock hoppers 19, each set including an upstream hopper and a downstream hopper, a rotary feeder 21 connected to an outlet of each downstream hopper 19, and a source of $N_2$ connected to the lock hoppers 19 and to an inlet end of the rotary feeder 21 for supplying $N_2$ to the lock hoppers 19 and the rotary feeder 21.

The lower lock hopper 19 of each set stores coal under pressure, typically 3 bar. Coal is supplied to the lower lock hopper 19 of each set via the upper lock hopper 19 of each set.

In a typical operating sequence for one of the sets of lock hoppers 19, the upper lock hopper 19 of the set is opened and is at ambient pressure and receives coal from one of the four outlet legs of the storage hopper 13. When the upper lock hopper 19 is full, the hopper 19 is closed and pressurised with $N_2$ to the same pressure as the lower lock hopper 19 of the set. When the required pressure is reached and the lower lock hopper is sufficiently empty, the lower lock hopper 19 is opened and coal is gravity fed from the upper lock hopper 19 into the lower lock hopper 19. The above operating sequence applies to each of the four sets of lock hoppers 19.

The rotary feeders 21 control supply of coal from the lower lock hoppers 19 into the coal supply lines 17. $N_2$ is supplied to inlet ends of the rotary feeders 21 and transports coal under pressure through the coal supply lines 17 to the lances 7*b* and injects coal into the vessel SRV via the lances 7*b*.

The capacity of each of the four coal supply means 15 is selected so that only three of the coal supply means 15 are required to supply required amounts of coal to the vessel SRV under standard operating conditions of the HIsmelt process. Accordingly, any one of the supply means 15 or the supply lines 17 or the lances 7*b* may be out of service at any time without affecting standard operation of the HIsmelt process.

The solids feed means also supplies separate streams of dolomite and waste oxides to the lances 7 that inject coal into the vessel SRV.

The flux feed means, generally identified by the numeral 25, includes a storage hopper 27 and supply means, generally identified by the numeral 29, that supplies separate streams of dolomite under pressure into two of the coal supply lines 17. The capacity of each of the two flux feed means 25 is selected so that only one of the coal supply means 15 is needed to supply at least substantially the required amount of dolomite to the vessel SRV under standard operating conditions of the HIsmelt process.

The waste oxides feed means, generally identified by the numeral 45, includes a storage hopper 47 and supply means, generally identified by the numeral 49, that supplies separate streams of waste oxides under pressure into the two coal supply lines 17 other than the coal supply lines 17 that are connected to the flux feed means 25.

Many modifications may be made to the embodiment of the present invention described above without departing from the spirit and scope of the invention.

By way of example, whilst the embodiment includes a single storage hopper 13 that supplies coal to the four lances 7*b*, the present invention is not so limited and extends to arrangements in which there is a plurality of storage hoppers 13, for example with one storage hopper supplying coal to one lance 7*b*.

By way of further example, whilst the embodiment includes a unit that includes a single storage hopper 13 that supplies coal to the four lances 7*b*, the present invention is not so limited and extends to multiple such units.

By way of further example, whilst the embodiment includes a coal drying and grinding plant 9, the present invention is not so limited and extends to arrangements in which the coal is supplied in a dry form and/or in a size range that does not require grinding (or pulverising). For example, drying of the coal may not be necessary in countries where there is limited rain fall and the coal tends to be dry because of the environment.

The invention claimed is:

1. A direct smelting plant for producing molten metal from a metalliferous feed material in a direct smelting process, including:

(a) a direct smelting vessel for holding a molten bath of metal and slag and a gas space above the bath;

(b) a solids feed means in the form of a means for injecting ground or pulverised solid carbonaceous material into the vessel, the carbonaceous material feed means including a grinding or pulverising means for producing ground or pulverised solid carbonaceous material, a plurality of lances for injecting the carbonaceous material into the vessel, and a carbonaceous material injection means for supplying ground or pulverised carbonaceous material under pressure to the lances and injecting carbonaceous material into the vessel via the lances, whereby the carbonaceous material injection means includes separate supply lines for each of the lances and a hopper for storing ground or pulverised solid carbonaceous material that is adapted to split the carbonaceous material into a plurality of uniform streams for feeding into the supply lines and is thereby adapted to supply carbonaceous material to each lance independently of the supply of carbonaceous material to the other lance or lances so that a breakdown of one or more than one lance or a breakdown of the carbonaceous material injection means for that lance or lances does not prevent the supply of carbonaceous material to the remaining operating lance or lances;

(c) a separate solids feed means in the form of a means for injecting solid metalliferous feed material into the vessel, the metalliferous material feed means including a plurality of lances for injecting metalliferous feed material into the vessel;

(d) a gas injection means for injecting an oxygen-containing gas into the vessel;

(e) an offgas duct means for facilitating flow of offgas from the vessel away from the vessel;

(f) a metal tapping means for tapping molten metal from the bath and transporting that molten metal away from the vessel; and (g) a slag tapping means for tapping slag from the bath and transporting that slag away from the vessel.

2. The plant defined in claim 1, wherein the carbonaceous material injection means is capable of supplying increased amounts of carbonaceous material to the remaining lance or lances to at least partially compensate for a loss of supply via the out of service lance or lances.

3. The plant defined in claim 1, wherein the storage hopper is adapted to store ground or pulverised solid carbonaceous material at ambient pressure.

4. The plant defined in claim 3, wherein the storage hopper is capable of holding an amount of ground or pulverised solid carbonaceous material required for at least 10 hours production at full production rate of the direct smelting process.

5. The plant defined in claim 1, wherein the carbonaceous material injection means includes a single unit that includes the storage hopper and a means for supplying ground or pulverised carbonaceous material from the storage hopper into each of the supply lines.

6. The plant defined in claim 5, wherein the supply means includes a series of lock hoppers for receiving ground or pulverised carbonaceous material from the storage hopper and storing the material under pressure.

7. The plant defined in claim 6, wherein the supply means includes a means for supplying inert gas to the lock hoppers for pressurising the lock hoppers.

8. The plant defined in claim 7, wherein the supply means includes a feed means connected to the lock hoppers for receiving and delivering controlled amounts of pressurised ground or pulverised carbonaceous material from the lock hoppers into the supply lines.

9. The plant defined in claim 5, wherein the supply means includes a means for supplying inert gas into the supply lines for transporting ground or pulverised carbonaceous material under pressure along the supply lines to the lances, with each lance receiving and injecting into the vessel a separate supply of carbonaceous material from the storage hopper.

10. The plant defined in claim 1, wherein the lances for injecting ground or pulverised carbonaceous material and metalliferous feed material are arranged in diametrically opposed pairs.

11. The plant defined in claim 1, wherein the metalliferous material feed means includes a main supply line and a pair of branch lines for supplying metalliferous feed material to the or each pair of lances.

12. The plant defined in claim 11, wherein the metalliferous material feed means includes a hot metalliferous feed material injection means for supplying pre-heated metalliferous feed material to the main supply line or lines of the feed means.

13. The plant defined in claim 1, wherein the means for injecting solid metalliferous feed material into the vessel is adapted to inject iron ore fines into the vessel.

14. The plant defined in claim 1, wherein the plant further includes a solids feed means for injecting flux into the vessel.

15. The plant defined in claim 14, wherein the flux feed means includes a flux injection means for supplying flux under pressure into at least one supply line of the carbonaceous material feed means.

16. The plant defined in claim 14 or claim 15, wherein the flux feed means includes a flux injection means for supplying flux under pressure into at least one main supply line of the metalliferous material feed means.

17. The plant defined in claim 1, wherein the plant further includes a solids feed means for injecting waste oxides into the vessel.

18. The plant defined in claim 17, wherein the waste oxides feed means includes a waste oxides injection means for supplying waste oxides under pressure into at least one supply line of the carbonaceous material feed means.

19. A solids feed means for a direct smelting vessel of a direct smelting plant for producing molten metal from a metalliferous feed material in a direct smelting process, which solids feed means includes a means for injecting ground or pulverised solid carbonaceous material into the vessel, the carbonaceous material feed means including a grinding or pulverising means for producing ground or pulverised solid carbonaceous material, a plurality of lances for injecting the carbonaceous material into the vessel, and a carbonaceous material injection means for supplying ground or pulverised carbonaceous material under pressure to the lances and injecting carbonaceous material into the vessel via the lances, whereby the carbonaceous material injection means includes separate supply lines for each of the lances and a hopper for storing ground or pulverised solid carbonaceous material that is adapted to split the carbonaceous material into a plurality of uniform streams for feeding into the supply lines and is thereby adapted to supply carbonaceous material to each lance independently of the supply of carbonaceous material to the other lance or lances so that a breakdown of one or more than one lance or a breakdown of the carbonaceous material injection means for that lance or lances does not prevent the supply of carbonaceous material to the remaining operating lance or lances.

20. A direct smelting process for producing molten metal from a metalliferous feed material in the direct smelting plant defined in claim 1, which process includes:

(a) producing ground or pulverised solid carbonaceous material; and (b) supplying separate streams of ground or pulverised carbonaceous material under pressure to a plurality of lances extending into a direct smelting vessel of the plant and injecting ground or pulverised carbonaceous material into the vessel via the lances.

21. The process defined in claim 20, wherein the process further comprises, following a decrease in the amount of carbonaceous material supplied to the vessel through one of the plurality of lances, increasing the amount of carbonaceous material supplied to the vessel through the remainder of the plurality of lances.

22. A direct smelting plant, for producing molten metal from a metalliferous feed material in a direct smelting process, the plant including:

(a) a direct smelting vessel for holding a molten bath of metal and slag and a gas space above the bath;

(b) a carbonaceous solids feeder connected to the vessel, the carbonaceous solids feeder including a grinder for pulverising solid carbonaceous material, at least two lances for injecting pulverised carbonaceous material into the vessel, and a carbonaceous material injector for supplying pulverised carbonaceous material under pressure to the lances and into the vessel, where the carbonaceous material injector includes separate supply lines for each of the lances and a hopper for storing ground or pulverised solid carbonaceous material, and is adapted to supply pulverised carbonaceous material from the hopper to each of the lances independently of the supply of carbonaceous material to the other lances or lances so that a breakdown of one or more than one lance or a breakdown of the carbonaceous material injection means for that lance or lances does not prevent the supply of carbonaceous material to the remaining operating lance or lances;

(c) a metalliferous solids feeder connected to the vessel and including at least two lances for injecting metalliferous feed material into the vessel;

(d) an oxygen-containing gas injector connected to the vessel;

(e) an offgas duct connected to the vessel;

(f) a metal tap connected to the vessel for tapping molten metal from the bath; and (g) a slag tap connected to the vessel for tapping slag from the bath.

23. A carbonaceous solids feeder connected to a direct smelting vessel of a direct smelting plant for producing molten metal from a metalliferous feed material in a direct smelting process, the carbonaceous solids feeder including a grinder for pulverising solid carbonaceous material, at least two lances for injecting pulverised carbonaceous material into the vessel, and a carbonaceous material injector for supplying pulverised carbonaceous material under pressure to the lances and into the vessel, where the carbonaceous material injector includes separate supply lines for each of the lances and a hopper for storing ground or pulverised solid carbonaceous material, and is adapted to supply pulverised carbonaceous material from the hopper to each of the lances independently of the supply of carbonaceous material to the other lances or lances so that a breakdown of one or more than one lance or a breakdown of the carbonaceous material injection means for that lance or lances does not prevent the supply of carbonaceous material to the remaining operating lance or lances.

24. A direct smelting process for producing molten metal from a metalliferous feed material in the direct smelting plant defined in claim 22, which process includes:

(a) producing ground or pulverised solid carbonaceous material; and (b) supplying separate streams of ground or pulverised carbonaceous material under pressure to a plurality of lances extending into a direct smelting vessel of the plant and injecting ground or pulverised carbonaceous material into the vessel via the lances.

* * * * *